US005431611A

United States Patent [19]

Silagy

[11] Patent Number: 5,431,611

[45] Date of Patent: Jul. 11, 1995

[54] SIZE ADJUSTABLE FINGER AND HAND EXERCISER

[76] Inventor: Howard Silagy, 100A Tec St., Hicksville, N.Y. 11801

[21] Appl. No.: 301,071

[22] Filed: Sep. 6, 1994

[51] Int. Cl.[6] ..... A63B 23/16

[52] U.S. Cl. ..... 482/47; 482/122

[58] Field of Search ..... 482/44, 47, 121, 122, 482/128; 84/467

[56] References Cited

U.S. PATENT DOCUMENTS

| | | | |
|---|---|---|---|
| 1,796,216 | 3/1931 | Pettersson | 482/47 |
| 3,447,415 | 6/1969 | Kime | 482/47 |
| 3,738,651 | 6/1973 | Norman et al. | 482/47 |
| 4,678,181 | 7/1987 | Ditsch et al. | 482/47 |
| 5,147,256 | 9/1992 | Silagy | 482/47 |

FOREIGN PATENT DOCUMENTS

| | | | |
|---|---|---|---|
| 1660709 | 7/1991 | U.S.S.R. | 482/47 |
| 1755834 | 8/1992 | U.S.S.R. | 482/44 |

*Primary Examiner*—Richard J. Apley
*Assistant Examiner*—Lynne A. Reichard

[57] ABSTRACT

A resistance spring-type exerciser for exercising one or more fingers against spring resistance while the exerciser is held in the palm of the user, in which finger-assigned plungers used for the exercise routines are adjustable both in their adjacent spaced relation to each other and in their height, to thereby accommodate the hand width and finger length dimensions of the user.

2 Claims, 2 Drawing Sheets

SIZE ADJUSTABLE FINGER AND HAND EXERCISER

The present invention relates to improvements for a hand exerciser of the type in which engaged plunger components are pressed against the resistance or urgency of exercise springs wherein the exerciser is readily adjusted in size to accommodate the hand width and finger length dimensions of the user.

EXAMPLE OF THE PRIOR ART

Routines contemplating the exercising of fingers against the resistance of springs is embodied in the construction and operational mode of many prior art hand exercising devices, as exemplified by the hand exercising device illustrated and described in my prior U.S. Pat. No. 5,147,256 issued to Howard Silagy entitled "Combination Individual Finger and Entire Hand Exerciser" on Sep.15, 1992.

The aforesaid and other known exercisers are typically made in large, medium and small sizes to accommodate the hand and finger dimensions of the user. A single exerciser thus cannot be shared by family members having significantly different size requirements.

It is an object of the present invention to provide an improved combination individual finger and entire hand exercise device overcoming the foregoing and other shortcomings of the prior art. More particularly, it is an object to provide an exerciser constructed to readily spread and lengthen or shorten the finger-activated plungers to thereby corresponding duplicate, in a single embodiment, the three prior art large, medium and small size variations, the referenced construction to be fully explained in detail as the description proceeds.

The description of the invention which follows, together with the accompanying drawings should not be construed as limiting the invention to the example shown and described because those skilled in the art to which this invention appertains will be able to devise other forms thereof within the ambit of the appended claims.

Figure 2:
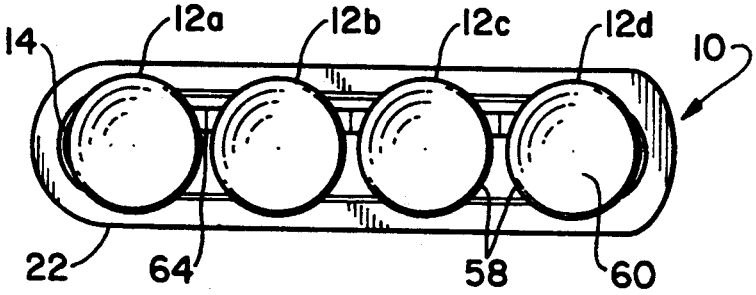
FIG. 2 is a plan view thereof.

The within finger and hand exerciser, generally designated 10, includes four resistance spring plunger-type finger-actuated members 12*a*, 12*b*, 12*c* and 12*d*, each attached at 16 to a base 14 having a palm-shaped elastomeric cover frictionally or otherwise appropriately attached to the base 14, such that in use the user can conveniently grasp the exerciser 10 in his/her palm and non-exercising thumb and selectively urge one or more of the plungers 12*a*–12*d* in descending movement against spring resistance.

Finger and hand exercising devices, of which device 10 is exemplary, are generally known, but are devoid of the capability of being adjusted to the hand width and finger length dimensions of the user with the facility that characterizes the construction of device 10. Stating the adjustments generally, which will be explained in greater detail subsequently, hand width variations are accommodated by a pivotal traverse permitted at the screw 16 connection through a cooperating hole 28, washing 18 and nut 20 for each finger-actuated member, such that as illustrated in FIG. 1 finger exerciser 12*a* can be outwardly inclined relative to adjacent finger exerciser 12*b* and by such inclination correspondingly increase the width of the device 10.

Figure 1:
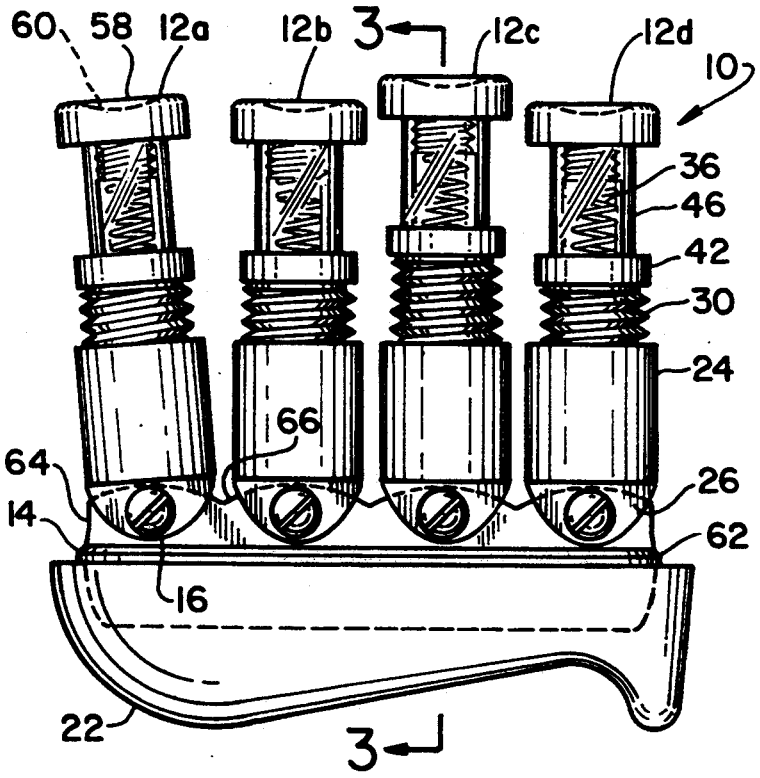
FIG. 1 is a front elevational view of the within inventive finger exerciser.

Still referring to FIG. 1, it can be noted that with appropriate threaded adjustment of threaded number 30 in an internally threaded housing 24 that the height of a finger-actuated member is correspondingly adjusted, such that finger-actuated member 12*c* is raised to a height greater than adjacent finger-actuated members 12*b* and 12*d*, to thereby adjust for variations in finger lengths of a user.

Figure 4:
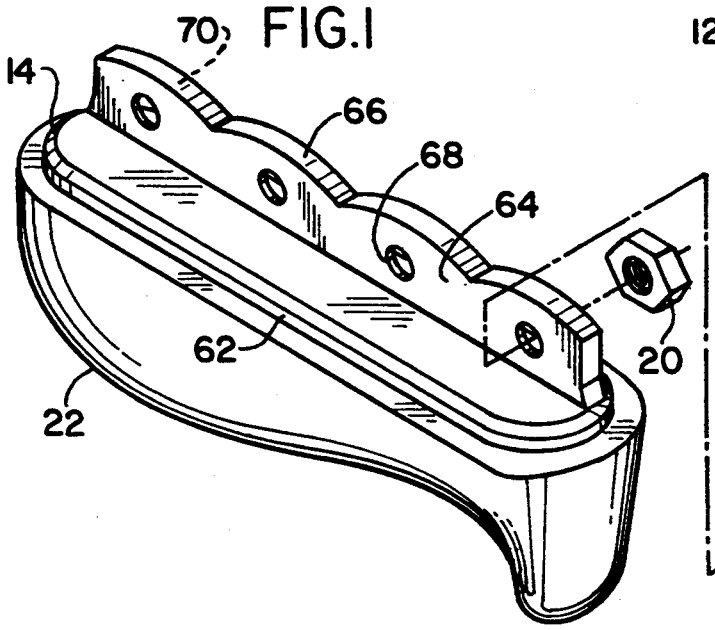
FIG. 4 is a perspective view illustrating the components in spaced relation.
Figure 4:
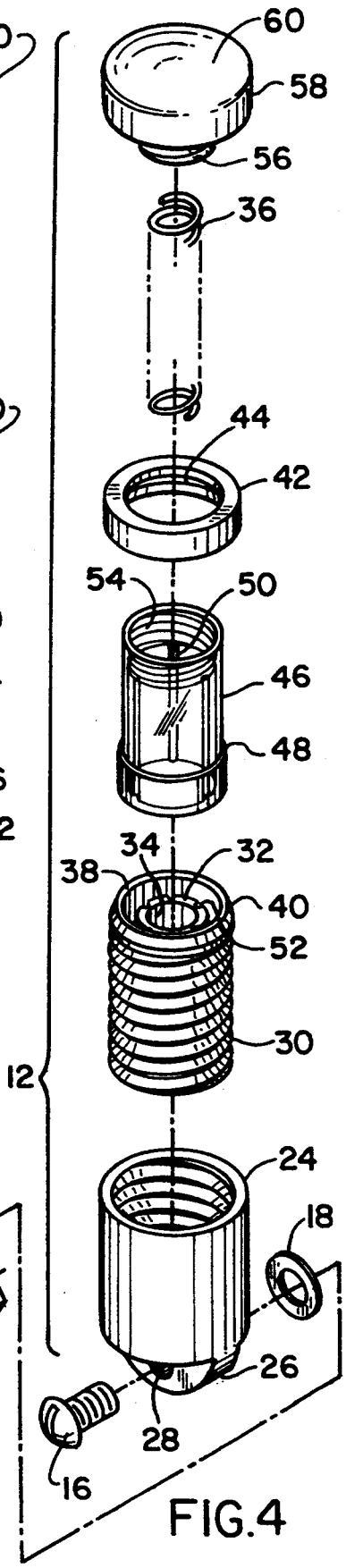
Figure 3:
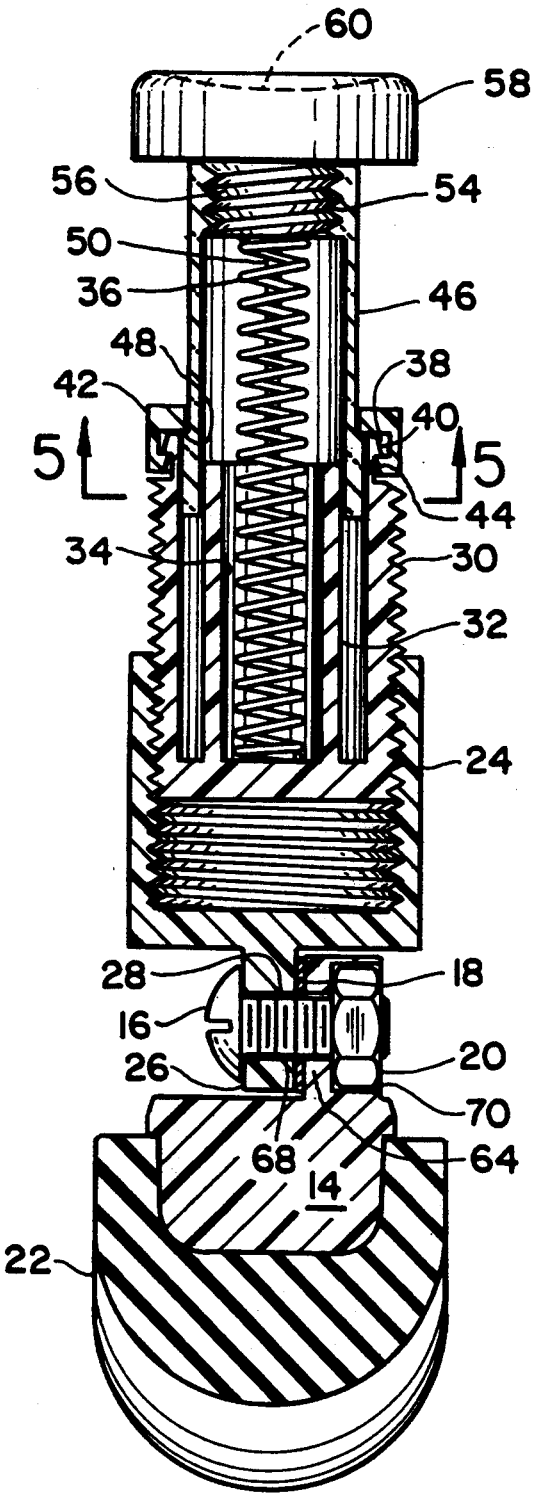
FIG. 3 is a cross-sectional view, on an enlarged scale, as taken along line 3—3 of FIG. 1.

As may best be understood from the exploded view of FIG. 4, the components of each finger-actuated member are identical and include a hollow cylindrical housing 24, internally threaded as illustrated, having a circular configuration 26 depending therefrom which is secured by screw 16 to an upstanding projection 66 of the base 14, the circular shape of 26 providing, as may best be appreciated from FIG. 1, the clearance for a pivotal traverse about the axis established by screw 16 projected through aligned openings 68,28. To prevent inadvertent rotative movement in the connecting nut 20 during a pivotal traverse, each nut 20 is seated in a recess 70, as shown in FIG. 3.

Figure 5:
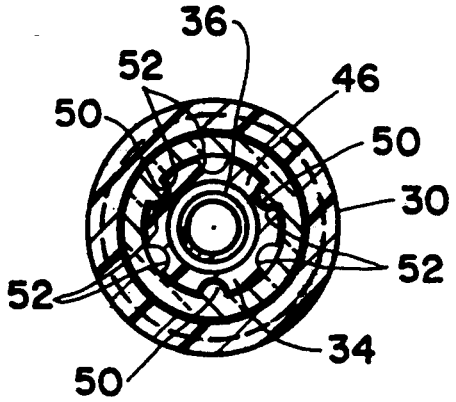
FIG. 5 is a cross-sectional view taken along line 5—5 of FIG. 3.

Still referring primarily to FIG. 4, height adjustment for finger length variations is achieved using an externally threaded height-adjusting member 30 disposed in threaded engagement with housing 24 and having a closed bottom (FIG. 3) for receiving in seated relation thereon an exercise spring 36, the threaded adjustment of member 30 either raising or lowering the height of a finger-actuated member 12*a*–*d*. To maintain proper tracking during a 12*a*–*d* plunger compression and release, integral with the closed bottom of member 30 (FIGS. 3 and 4) is an upstanding tracking member 32 in a clearance position centrally of member 30 having spline grooves 52 circumferentially spaced thereabout and a central opening 34 for positioning the helical spring 36 against the member 30 closed bottom. Slidably disposed in relation to the fixed member 30 is a clear plastic tube 46 for containing spring 36. Tube 46 is internally threaded at 54 and extruded or otherwise appropriately provided with aligning circumferentially spaced spline projections 46 and a stop shoulder 48. As shown in FIG. 5, the spline projections 46 project into a cooperating spline groove 52 to confine movement to a vertical axis and prevent inadvertent rotative movement and, as shown in FIG. 3, the shoulder 48 abuts a retaining ring 42 threadably engaging with internal threads 44 the external upper threads of member 30 to limit ascending movement in a plunger 12*a*–*d* under spring urgency incident to release of the plunger.

Completing the construction of each finger-actuating plunger 12*a*–*d* is a cap 60 with a flange 58 adapted to engage ring 42 to limit descending movement, and having a threaded depending projection 56 to engage the tube threads 54 so that a plunger 12*a*–*d* is urged through descending movement against the compression and thus resistance of spring 36 to the extent permitted until abutment of flange 58 with the retainer ring 42.

It is contemplated that the spring compartment bounded internally of tube 46 be made accessible upon threaded removal of cap 60 which facilitates replacement and insertion of an exercise spring 36 of an appropriate construction material and helical turns or configuration to vary, as desired, the exercise effort in using the device 10.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a finger exerciser of a type having four resistance spring plunger-finger-actuated members selectively urged in descending movement against spring resistance by a corresponding finger while held in the user's palm and the grasp of a non-actuating thumb, the improvements comprising a base adapted to be positioned in the user's palm and thumb grasp, and for each finger a hollow internally threaded cylindrical housing pivotally connected adjacent one end to said base to provide a traversing degree of movement, a height-adjusting externally threaded cylindrical member disposed in threaded engagement with said internally threaded housing having a closed bottom for receiving in seated relation thereon an exercise spring and providing an ascending and descending degree of movement for a finger-actuated member incident to threaded adjustment of said height-adjusting member in said housing, an upstanding tracking member connected to extend from said height-adjusting member closed bottom in a clearance position centrally thereof having vertically oriented spline grooves circumferentially spaced thereabout, a cylindrical spring-containing tube with an upper end internally threaded and an open bottom end having cooperating vertically oriented spline projections thereabout slidably disposed in said height-adjusting member with said spline projections thereof in projected relation within said spline grooves adapted to partake of descending movement against spring resistance and ascending movement under spring urgency, a helical spring disposed to extend through said spring-containing tube into seated relation on said height-adjusting member closed bottom effective to alternately provide said descending movement resistance and said ascending movement urgency, and an internally threaded cap threadably engaged to said internal threads of said spring-containing tube to serve as a closure therefore and a finger support when in exercising use and threadably removable therefrom incident to using a replacement spring, whereby said pivotal traversing and ascending and descending degrees of movement contribute to making size adjustments to the hand width and finger length dimensions respectively of the user and the removability of said cap to the use of a replacement spring selected for a desired degree of exercising effort.

2. A finger exerciser as claimed in claim 1 including a ring threadably attached adjacent an upper end of said height-adjusting member to serve as a stop for said cap on a finger-actuated member during descending exercising movement thereof.

* * * * *